US005133388A

United States Patent [19]

Tholander

[11] Patent Number: 5,133,388

[45] Date of Patent: Jul. 28, 1992

[54] WEFT MEASURER AND STORER WITH BISTABLE SOLENOID CONTROLLED STOP PIN

[75] Inventor: Lars H. G. Tholander, Ulricehamn, Sweden

[73] Assignee: IRO AB, Ulricehamn, Sweden

[21] Appl. No.: 573,196

[22] PCT Filed: Nov. 25, 1988

[86] PCT No.: PCT/EP88/01075

§ 371 Date: Jul. 27, 1990

§ 102(e) Date: Jul. 27, 1990

[87] PCT Pub. No.: WO89/05365

PCT Pub. Date: Jun. 15, 1989

[30] Foreign Application Priority Data

| | | | |
|---|---|---|---|
| Nov. 29, 1987 | [SE] | Sweden | 8704776 |
| Dec. 2, 1987 | [SE] | Sweden | 8704850 |
| Jan. 11, 1988 | [DE] | Fed. Rep. of Germany | 8800216 |

[51] Int. Cl.[5] ..... D03D 47/36

[52] U.S. Cl. ..... 139/452; 335/234

[58] Field of Search ..... 139/452, 455; 335/229, 335/230, 234; 242/47.01

[56] References Cited

U.S. PATENT DOCUMENTS

| | | | |
|---|---|---|---|
| 3,202,886 | 8/1965 | Kramer | 335/234 |
| 4,541,462 | 9/1985 | Tholander | 139/452 |
| 4,859,975 | 8/1989 | Uetsuhara | 335/234 |

*Primary Examiner*—Andrew M. Falik

*Attorney, Agent, or Firm*—Flynn, Thiel, Boutell & Tanis

[57] ABSTRACT

An apparatus for storing, feeding and measuring a weft yarn of a jet weaving machine is provided with an annular housing containing at least one weft yarn-stopping device. In said stopping device a stop member is arranged for a displacement between a passive position and a stop position. Said stop member is actuated by a current-energizable solenoid coil. Said stopping device is provided with a bistable and self-holding mounting arrangement for the stop member. Said stop member is connected with a polarized permanent magnet. For an actuation of the stop member in order to displace it away from its initial end position said current-energizable solenoid coil is electrically connected with a current-direction-reversing-circuit.

17 Claims, 9 Drawing Sheets

| STOPMEMBER n = 1 ÷ 16 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 16 | | | | | | | | | | | | | | | B | A |
| 15 | | | | | | | | | | | | | | A | B | |
| 14 | | | | | | | | | | | | | B | A | | |
| 13 | | | | | | | | | | | | A | B | | | |
| 12 | | | | | | | | | | | B | A | | | | |
| 11 | | | | | | | | | | A | B | | | | | |
| 10 | | | | | | | | | B | A | | | | | | |
| 9 | | | | | | | | A | B | | | | | | | |
| 8 | | | | | | | B | A | | | | | | | | |
| 7 | | | | | | A | B | | | | | | | | | |
| 6 | | | | | B | A | | | | | | | | | | |
| 5 | | | | A | B | | | | | | | | | | | |
| 4 | | | B | A | | | | | | | | | | | | |
| 3 | | A | B | | | | | | | | | | | | | |
| 2 | B | A | | | | | | | | | | | | | | |
| 1 | B | | | | | | | | | | | | | | | A |

SOLENOID n = 1 ÷ 16

| STOPMEMBER n = 1 ÷ 16 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 16 | B | | | | | | | | | | | | | A | A | B |
| 15 | | | | | | | | | | | | | B | B | A | A |
| 14 | | | | | | | | | | | | A | A | B | B | |
| 13 | | | | | | | | | | | B | B | A | A | | |
| 12 | | | | | | | | | | A | A | B | B | | | |
| 11 | | | | | | | | | B | B | A | A | | | | |
| 10 | | | | | | | | A | A | B | B | | | | | |
| 9 | | | | | | | B | B | A | A | | | | | | |
| 8 | | | | | | A | A | B | B | | | | | | | |
| 7 | | | | | B | B | A | A | | | | | | | | |
| 6 | | | | A | A | B | B | | | | | | | | | |
| 5 | | | B | B | A | A | | | | | | | | | | |
| 4 | | A | A | B | B | | | | | | | | | | | |
| 3 | B | B | A | A | | | | | | | | | | | | |
| 2 | A | B | B | | | | | | | | | | | | | |
| 1 | A | A | | | | | | | | | | | | | B | B |

SOLENOID n = 1 ÷ 16

WEFT MEASURER AND STORER WITH BISTABLE SOLENOID CONTROLLED STOP PIN

BACKGROUND OF THE INVENTION

1. Field of the Invention

The invention relates to an apparatus for storing, feeding and measuring yarn, particularly the weft yarn in a jet loom.

2. Description of Related Art

It is known to provide an apparatus for storing, feeding and measuring yarn, particularly the weft yarn in a jet loom, comprising a stationary storage drum adapted to have a temporary yarn supply wound thereonto by means of a winder appliance, and to have the yarn withdrawn therefrom over a withdrawal end. An annular housing surrounds the storage drum with an annular gap defined therebetween. The annular housing carries at least one yarn stopper device comprising a stop member mounted for radial displacement between a passive position away from the annular gap and a stop position extending through the annular gap. At least one current-energizable solenoid is provided as an actuator for said stop member. Abutment stops are provided for limiting the displacements of the stop member.

In apparatus of this type known from European Patent 107,110 and European Patent Application 148,356(which correspond to U.S. Pat. No. 4,541,462), the stop member is a ball of a ferromagnetic material mounted for back and forth displacement between a permanent magnet disposed at a recessed position with respect to the surface of the storage drum and acting as one of said abutment stops, and the stationary core of the solenoid acting as the other abutment stop, the axis of said solenoid being aligned in the radial direction. As long as the solenoid is deenergized, the ball is retained on the permanent magnet, and the annular gap is open for the passage therethrough of the yarn. When the solenoid is energized, it generates a magnetic force overcoming the holding force of the permanent magnet, so that the ball is attracted by the core of the solenoid and retained thereon as long as the solenoid is energized. In this position the ball blocks the annular gap, preventing the yarn from passing therethrough for a predetermined period of time. As soon as the solenoid is deenergized, the ball returns to the permanent magnet.

In a similar apparatus known from EP-A-0 112 555 and EP-A-0 111 308, the solenoid is aligned in a radial direction with respect to the drum surface and provided with a magnet armature having a pin-shaped extension adapted on energization of the solenoid to be pushed into a recess formed in the drum surface to thereby block the annular gap, whereas in the deenergized state of the solenoid it is retracted by a retraction spring and retained in its passive position. The same principle is known from DE-GM 84 29 220.

In these known embodiments of the apparatus, the solenoids of the stopper devices are of a heavy-duty type, i.e. relatively strong and bulky, or provided with a great number of windings, resulting in an undesirable increase of the dimensions of the annular housing. The energization of the solenoid for the full duration of the stop position results in a considerable load acting thereon, and thus in undesirable heating of the solenoid. When, as is usually the case, a great number of stopper devices with associated solenoids is provided along the periphery of the storage drum, the amounts of heat generated by the selective and successive energization of the solenoids accumulate, so that additional cooling provisions may be required in the case of extended and continuous operation. A further serious disadvantage of the known apparatus is the shifting inertia, i.e. the slow response of the stop members due to their considerable mass to be displaced. There is a growing tendency to reduce the dimensions of apparatus of this type in consideration of the restricted installation space in a loom, which may have to accommodate up to eight or even more such devices on one side. The reduction of the dimensions of these devices results in a considerably increasing revolution speed of the yarn exit point about the withdrawal end of the storage drum, This speed being still further increased by the fact that modern looms are operated at progressively higher weft yarn shooting speeds. A rapid and smooth response and short shifting times of the stop members are therefore of growing importance in devices of this type, in combination with the requirement to keep their structural dimensions as small as possible and to avoid any excessive generation of tangible heat. In the known embodiments of the apparatus, finally, the required energization of the selected solenoid for the full duration of the stop position represents a further danger, because the usually employed transistor control circuit of the solenoid may collapse under the effect of the high load, resulting in a possibly dangerous overload of the solenoid and the consequent generation of excessive heat.

It is an object of the present invention to provide an apparatus of the type defined in the introduction, which is to be characterized by compact exterior dimensions, rapid and smooth response and short shifting times of the stop members, and reduced loads acting on the solenoids.

SUMMARY OF THE INVENTION

This object is attained, according to the invention, by providing the stopper device with bistable and self holding mounting means for alternately retaining the stopper device in its two end positions without any energization of the solenoid, the stop member being connected to a polarized permanent magnet and the solenoid being connected to a current reversing circuit for displacing the stop member from one of its end positions to the other, and vice versa.

As a result of the bistable retention of the stop member in its two end positions, the solenoid is no longer required to be continuously energized for holding the stop member in at least one of its end positions. The solenoid is thus merely required for generating the impulse for the displacement of the stop member at the right instant and in the right direction. In the end positions, the bistable mounting is responsible for the retention of the stop member irrespective of the duration of the stop position. This results in a very short energization period of the solenoid, a negligibly low thermic load for the solenoid, and the possibility of using a small solenoid having a small number of windings, so that its accommodation requires only a small space. This permits the apparatus to be of small and compact construction, even when it is provided with a great number of stopper devices. As the bistable mounting of the stop member renders a retraction spring superfluous, and as the mass of the stop member to be displaced is desirably small, the shifting times of the stop member are very short, and its response to the shifting impulse generated by the solenoid is rapid and smooth. This short shifting time and the rapid and smooth response permit a great number of stopper devices to be disposed at circumferentially spaced locations of an apparatus, even of rather small dimensions, even in the case of a high circulating speed of the yarn exit point at the withdrawal end of the storage drum due to high operating speeds of the yarn-consuming machine. The reduced loads applied to the solenoid also result in a reduction of the danger of load-induced damage to a usually employed transistor control circuit, so that the apparatus can reliably operate over extended periods of use without appreciable generation of heat. The energization of the solenoid through the current reversing circuit permits the solenoid to generate the acceleration impulse for the permanent magnet in both directions. An abbreviation of the shifting time of the stop member also results from the fact that the permanent magnet, after its separation from one abutment stop, attracts itself towards the other abutment stop, so that it is accelerated in the direction towards the other abutment stop, to thereby intensify the acceleration impulse generated by the solenoid as long as the latter is still energized.

In a further particularly advantageous embodiment, an even number of stopper devices is provided at uniform circumferential spacings. The solenoids may be aligned in the circumferential direction, resulting in a reduction of the radial dimensions of the annular housing. This arrangement results in the further particularly important advantage that at least two solenoids cooperate in each case for generating the acceleration impulse for the stop member. Each solenoid has thus to generate only a part of the total force required. Although at least two solenoids are responsible for the displacement of any stop member, the described arrangement results in that at the same time each solenoid is responsible for the displacement of two stop members, so that the total number of solenoids may be equal to the total number of stopper devices, irrespective of the dual function of the cooperating solenoids.

In another preferred embodiment the magnetic force of the permanent magnet, which has the acceleration impulse generated by the energization of the solenoid or solenoids, respectively, in both directions applied thereto, is used for ensuring the retention of the stop member in both of its end positions. In each end position the permanent magnet supplies the magnetic force for holding it on the respective abutment stop made of a ferromagnetic material. The abutment stops are thus provided not only for limiting the stroke of the stop member, but also for absorbing the holding forces in the two stable end positions of the stop member.

A soft-iron core is particularly effective for intensifying the magnetic flux in the solenoid or solenoids, respectively, so that a strong acceleration impulse results from the cooperation of the pairs of solenoids.

Since the permanent magnet is also capable of supplying its holding force in cooperation with the soft-iron core, the latter may additionally be used as the abutment stop defining the passive position.

A current reversing circuit comprising transistors activated by a central control unit obtains a short shifting time of the stop member. Since the solenoid or solenoids, respectively, are in each case energized for only a short period and under relatively low load, the power obtained by the discharge of a capacitor is sufficient for this purpose. The employ of capacitors in the manner described is also useful for eliminating the problem of an undesirable overload of the solenoids in the case of a collapse of the transistor control circuit.

When each solenoid is associated to two stop members, it is ensured that in each case, only the selected stop member is shifted to the stop position.

When the holding force between the permanent magnet and each abutment stop is smaller than the magnetic force generated by the pair of solenoids and acting on the permanent magnet of a given stopper device is greater than the magnetic forces generated by the energization of each solenoid acting on the adjacent stopper devices, only the selected stop member is shifted to its stop position, and that the adjacent stop members are retained in the passive position by the forces generated in the bistable mounting arrangement. It is also ensured that on return of the previously activated stop member to its passive position, none of the adjacent stop members is inadvertently shifted to the stop position.

Preferably the solenoids are energized so that the magnetic forces acting on the stop members disposed adjacent the selected stop member are neutralized by the energization of the solenoids located on opposite sides of the respective stop members, whereby the latter are retained in their passive positions by the holding forces in the bistable mounting arrangement.

In order to still further reduce the loads applied to the solenoids, an even number of additional solenoids may advantageously be energized with the solenoids for displacing the stop member for generating the force required for the acceleration impulse for the stop member to be activated.

Of particular importance is that the solenoids are deenergized when the stop member is in its end positions because it is effective to reduce the thermic load applied to the solenoids and thus the generation of heat in the annular housing. For the duration of the stop position, the bistable mounting arrangement is responsible for holding the stop member.

In an alternate embodiment wherein a radially aligned solenoid, the space requirement is smaller than in the case of known embodiments, because the bistable mounting arrangement permits the use of a weak and small solenoid cooperating with the current reversing circuit for generating the acceleration impulse for the stop member in both directions.

In a further alternate embodiment the two solenoids associated with each stopper device extend substantially parallel to the drum axis and they cooperate with one another for generating the acceleration impulse for the respective stop member, so that it is possible to use small and weak solenoids. In this case the solenoids are without any influence on adjacent stopper devices. In the axial direction of the storage drum there is sufficient space for accommodating the solenoids in this arrangement. The radial dimensions of the annular housing may still be desirably small. This arrangement also permits the stopper devices to be disposed closely adjacent one another.

In a further advantageous embodiment, the solenoids are disposed in an oblique and overlapping arrangement which permits a great number of stopper devices to be accommodated in the annular housing even in the case of a storage drum having a small diameter. The two solenoids associated to each stop member exert no influence on the stop members of adjacent stopper devices.

The stopper devices may be formed as simple and accurately prefabricated structural units adapted to be inserted into the annular housing. This does not only simplify the assembly operations, but also permits the down-times for repairs to be reduced, as the stopper devices are rapidly replaceable. The resilient seal protects the stopper device from the intrusion of contaminants impairing its function.

A further embodiment satisfies the requirement to keep the displaceable mass of the stop member as small as possible to thereby achieve the desired rapid and smooth response and the short shifting time of the stop member. In this case the abutment stops perform a third function in that they are responsible for the slidable mounting of the stop member. The susceptibility to wear of the lightweight stop member is eliminated by the wear-retarding lining.

The provisions of resilient buffers are helpful for reducing mechanical wear in the stopper device and for limiting the generation of undesirable noise in operation of the apparatus. The impact of the stop member is resiliently dampened at both end positions.

The characteristics, finally, of claim 19 are advantageous for permitting the stopper devices to be accurately adjusted to given operating conditions.

BRIEF DESCRIPTION OF THE DRAWINGS

Embodiments of the subject matter of the invention shall now be described with reference to the drawings, wherein.

DESCRIPTION OF THE PREFERRED EMBODIMENTS

Figure 1:
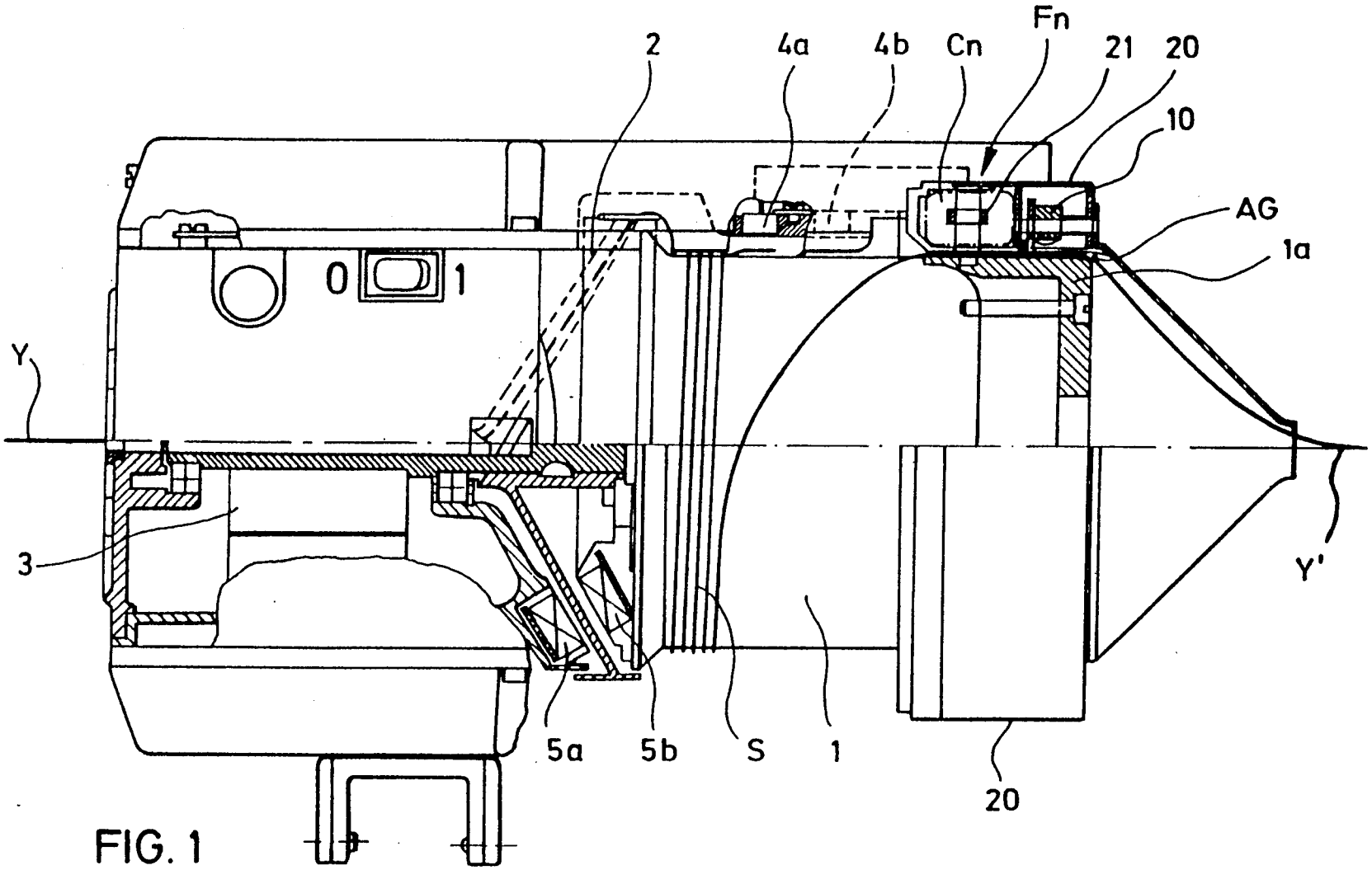
FIG. 1 is a side view, partially in cross-section, of a yarn storage, feeding and measuring apparatus.

An apparatus according to FIG. 1 for storing, feeding and measuring a yarn Y, Y', particularly a weft yarn in a jet loom, comprises a stationary storage drum 1 to which yarn Y is supplied from a supply reel (not shown) through a hollow shaft of a winding device 2. Winding device 2 has a hollow arm adapted to be rotated by an electric motor 3 for tangentially winding yarn Y onto the circumferential surface of storage drum 1 so as to form a yarn supply of several windings thereon. Yarn Y is withdrawn from storage drum 1 over an exit end 1*a* thereof, with the exit point of yarn Y travelling circumferentially around the exit end. Two yarn supply sensors or detectors 4*a*, 4*b* are connected to a control unit (not shown) of electric motor 3 for energizing and deenergizing motor 3 in accordance with the yarn supply S stored on drum 1. This control arrangement and its details are known and specifically described in European Patent Application 171,516. The stationary housing of the apparatus contains an arrangement of permanent magnets 5*a* aligned with permanent magnets 5*b* in the rotatably mounted storage drum 1, which is thereby kept stationary.

In order to enable the length of yarn Y' released for withdrawal during each operating phase to be accurately measured, a measuring device is accommodated in an annular housing 20 disposed adjacent the exit end 1*a* of storage drum 1. Annular housing 20 surrounds the circumferential surface of storage drum 1 so as to define an annular gap AG therebetween for yarn Y' to pass therethrough as it is being withdrawn. Disposed in annular housing 20 is a sensor 10, suitably of an optical type, for generating an electric output signal in response to each passage thereby of yarn Y' and for applying this signal to a control unit (not shown) of the type suitably including a microprocessor. For enabling the passage of yarn Y' being withdrawn to be reliably detected, it is also possible to provide two or more identical sensors 10 at suitable positions adjacent exit end 1*a*. Annular housing 20, by the way, is fixedly connected to a stationary housing portion.

Figure 3:
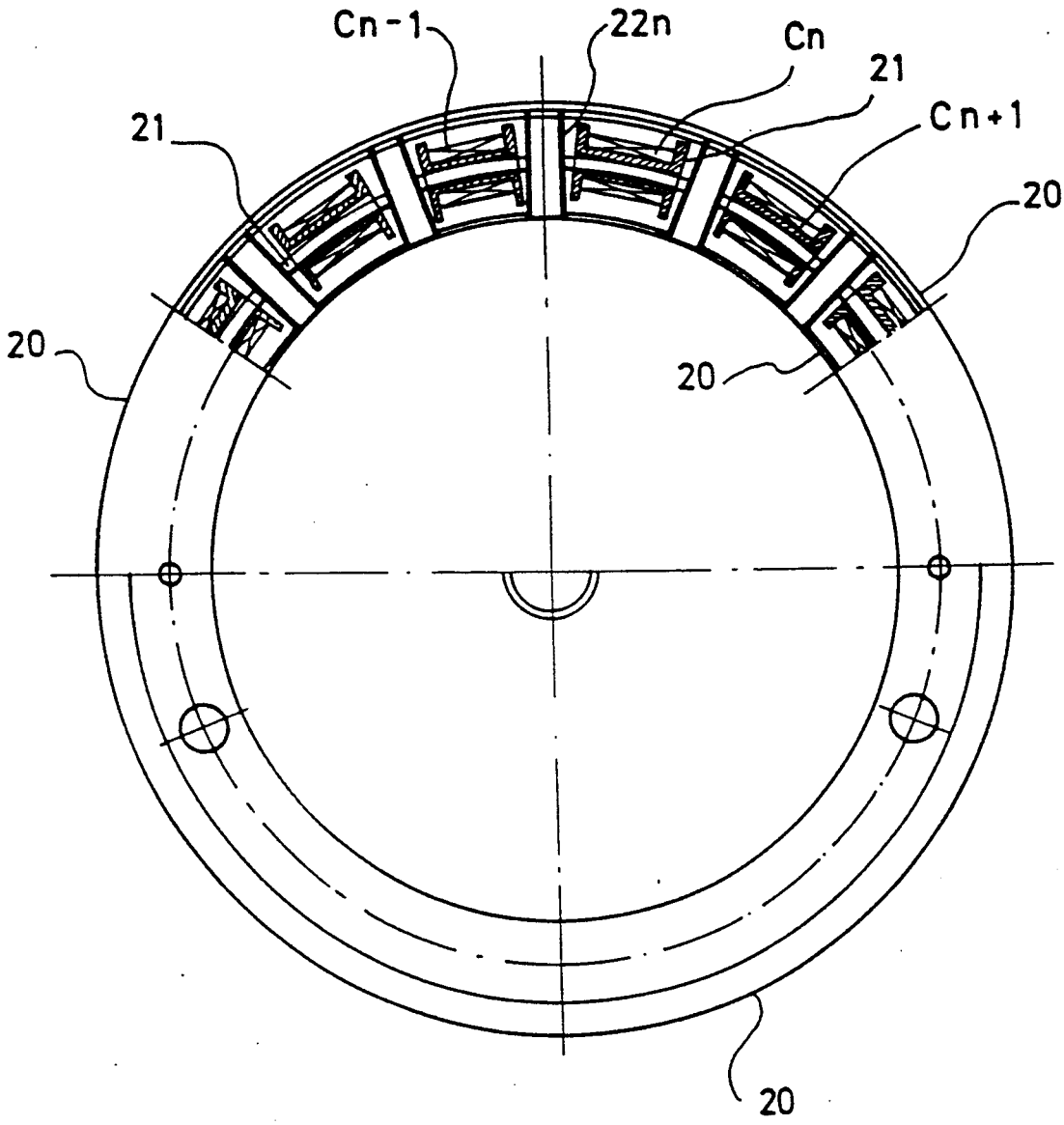
FIG. 3 is a front view, partially in cross-section, of the apparatus.
Figure 4:
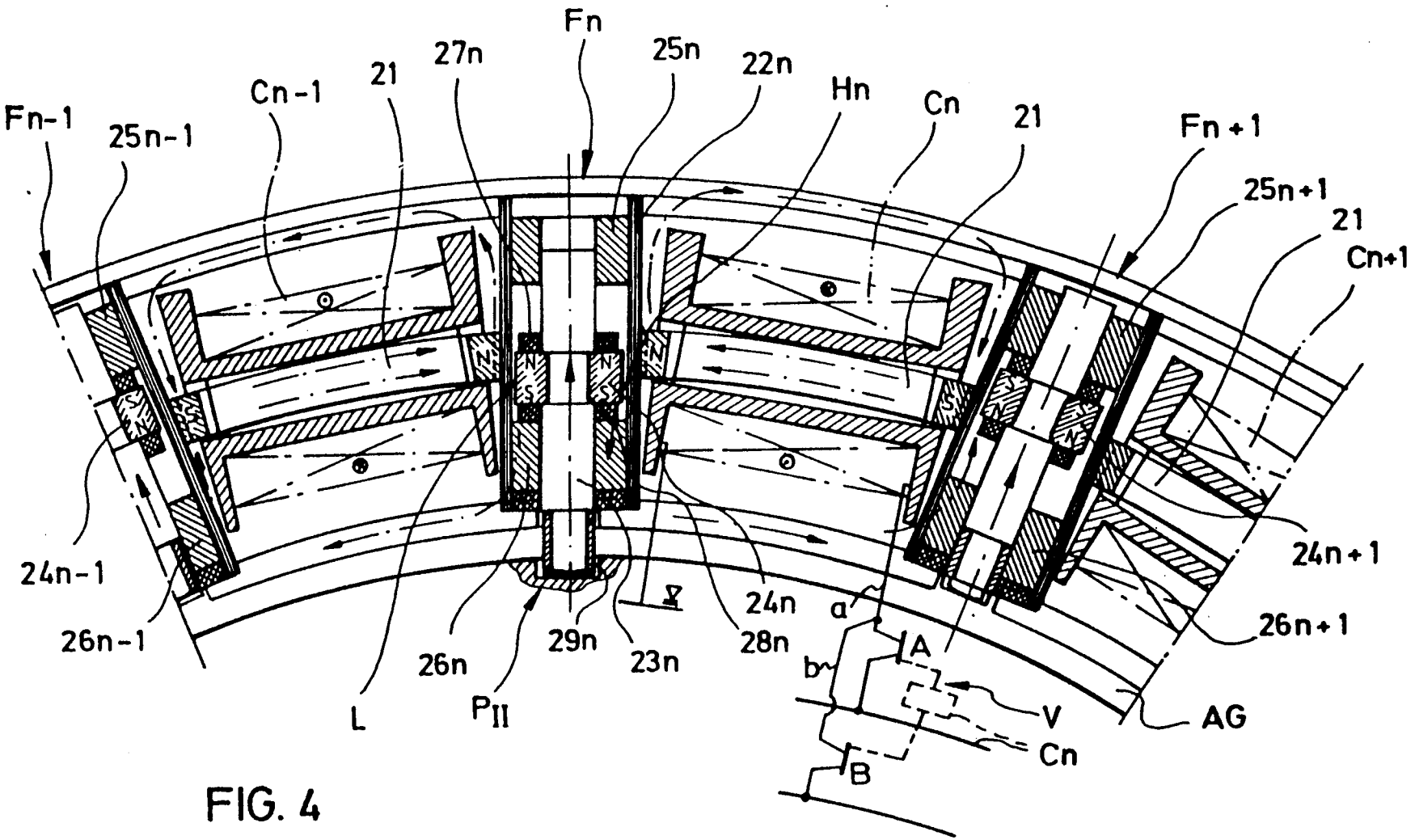
FIG. 4 is an enlarged fragment of FIG. 3, FIGS. 5*a* and 5*b* are enlarged views illustrating two different operating phases of FIG. 4, FIGS. 6*a* and 6*b* are diagrammatic illustrations of circuitry for the apparatus shown in the preceding figures.

Disposed in annular housing 20 at circumferentially spaced locations is a plurality of stopper devices Fn, in the present example sixteen stopper devices Fn, adapted to be controlled by electromagnetic means. Associated to each stopper device Fn is at least one solenoid Cn (FIG. 2) operable to apply respective acceleration impulses to a stop member 23*n* for the radial displacement thereof between two end positions PI and PII, respectively. PI is the passive position of stop member 23*n*, in which it is retracted into annular housing 20 so as to permit the passage of yarn Y' through annular gap AG. The other end position PII (FIG. 4) is the stop position, in which stop member 23*n* extends through annular gap AG so as to form a retaining stop for yarn Y'. In FIGS. 3 and 4 it will be recognized that each stopper device Fn has at least two solenoids Cn associated thereto, the solenoids being mounted in annular housing 20 with their axes extending substantially in the circumferential direction, so that the two ends of each solenoid cooperate with two adjacent stopper devices Fn.

The actuation (displacement of stop members 23*n* to their passive positions PI or to their stop positions PII, respectively) of each selected stopper device Fn at the proper time, in accordance with the required weft yarn length (which is adjustable) and in accordance with the signals of sensor 10, is calculated by a microprocessor control unit. This principle is explained in detail in European Patent 107,110.

Solenoids Cn, in the present example sixteen solenoids, are accommodated in recumbent positions in annular housing 20, the latter consisting of a magnetically conductive material, for instance steel. An annular core 21 of a magnetically conductive material, for instance iron, extends through all solenoids Cn. Between any two adjacent solenoids Cn, core 21 is formed with respective recesses Hn (FIG. 4) accommodating a respective stopper device Fn. Each stopper device Fn comprises a short bushing 22*n* of a magnetically nonconductive material, for instance brass, having both of its ends secured in annular housing 20 and extending through the respective recess Hn of core 21. Stop member 23*n* is formed as a pin, suitably of a plastic material, carrying an annular polarized permanent magnet 24*n* at its longitudinal center. Secured in bushing 22*n* at spaced locations are two abutment stops 25*n*, 26*n* suitably formed of a ferromagnetic material with an annular configuration. The two abutment stops 25*n* and 26*n* serve the additional purpose of slidably mounting stop member 23*n*. Permanent magnet 24*n* consists of a highly active magnetic material of the type, for instance, available under the designation VACODYM. Permanent magnet 24*n* cooperates with abutment stops 25*n* and 26*n* to form a bistable mounting means L for stop member 23*n*, inasmuch as the magnetic force of permanent magnet 24*n* acts to hold it against the respective abutment stop 25*n* or 26*n* in the two end positions PI and PII, respectively. The displacement of stop member 23*n* between its two end positions is controlled by the associated solenoids Cn adapted on being energized to generate a magnetic flux to thereby create an acceleration impulse acting on stop member 23*n*. This principle will be explained in detail hereinafter. The end of bushing 22*n* facing towards storage drum 1 is closed by a resilient seal 30*n*. The end of stop member 23*n* facing towards storage drum 1 has a wear-retarding lining 29*n* bonded thereto, in the present example in the form of a collar applied thereto by spraying. Adhesively secured to stop member 23*n* or to the two end faces of permanent magnet 24*n* are respective resilient buffer members 27*n* and 28*n*.

The permanent magnets 24*n*, 24*n*−1, 24*n*+1 of mutually adjacent stopper devices Fn, Fn−1, Fn+1 are disposed with oppositely directed polarities, as indicated in FIG. 4 by the designation of respective poles S and N. The lining 29*n* on stop members 23*n* may be made of hardened steel or of a ceramic material. Seal 30*n* may for instance be made of a felt-like material.

Figure 2:
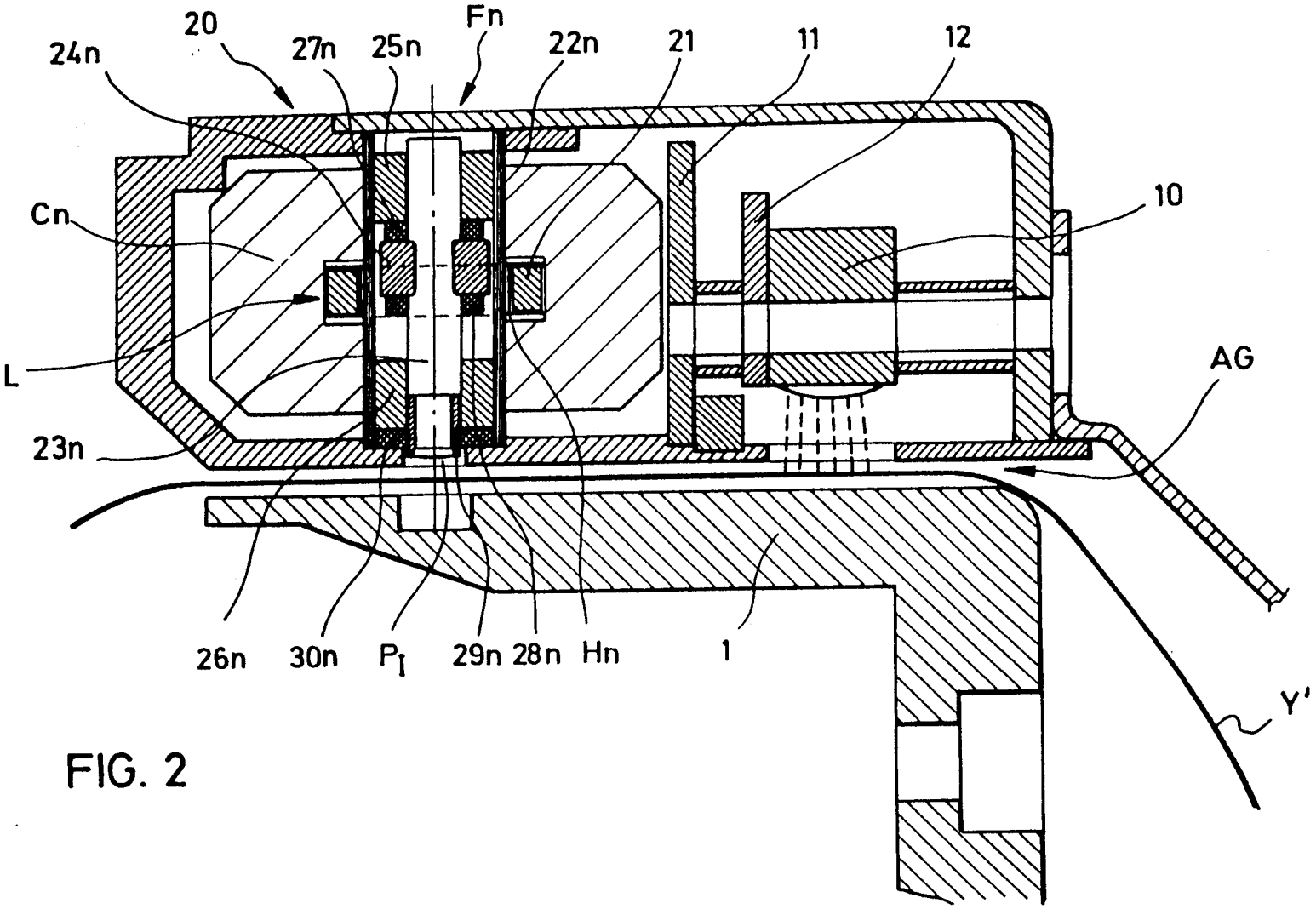
FIG. 2 is an enlarged sectional view of a fragment of FIG. 1.

As shown in FIG. 2, sensor 10, which includes a circuit board 12 carrying an electronic control circuit for amplifying the output signal of sensor 10, is shielded from the magnetic field of the solenoids by a disc 11 incorporated in annular housing 20.

Figure 5A:
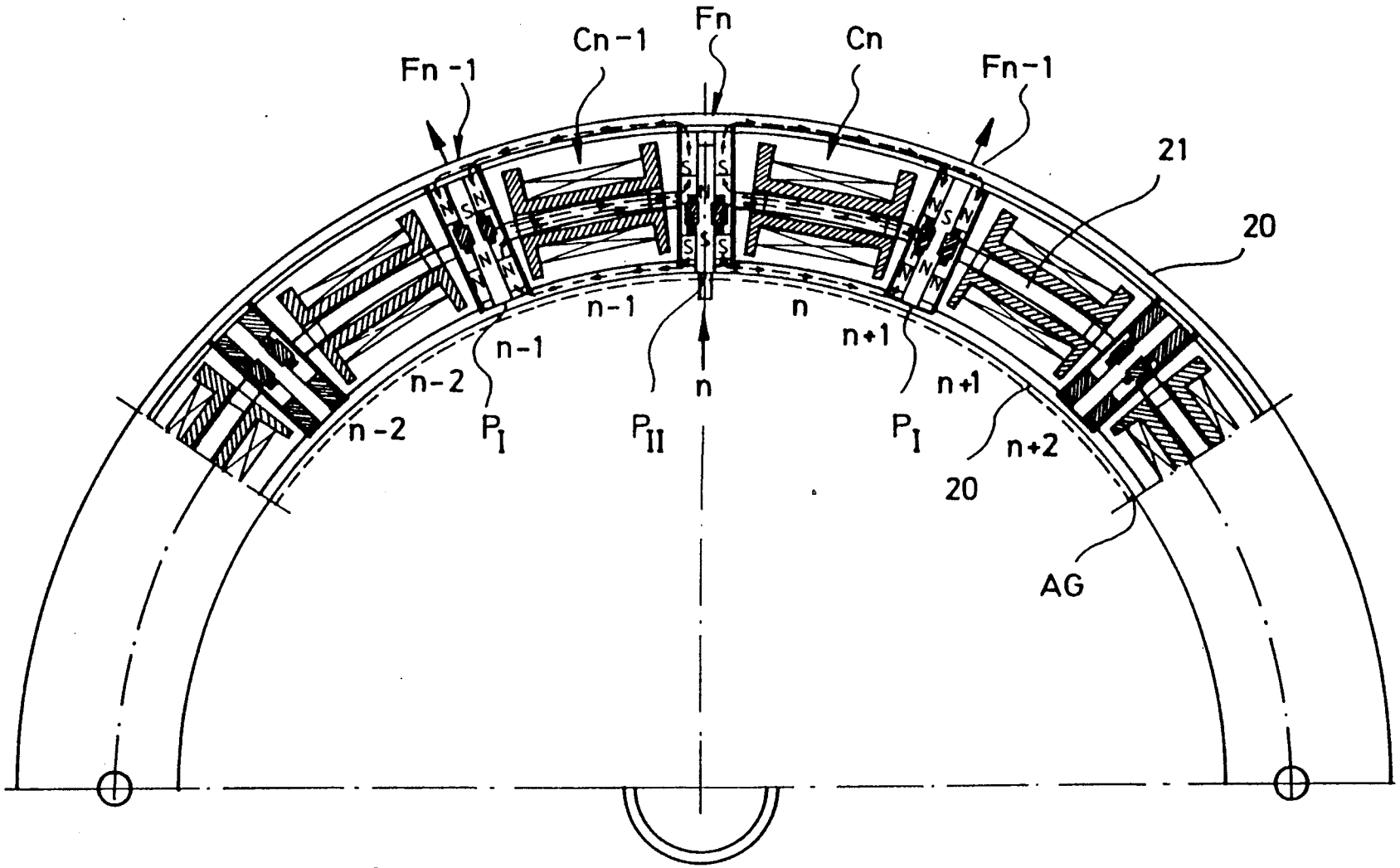

As shown in FIG. 4, each solenoid Cn is connected to a respective current reversing circuit U adapted to be controlled by a central control unit CU. A respective pair of parallel energizing conductors is connected to separate current conductors through separately controllable transistors A and B, respectively, transistors A and B being adapted to be controlled by central control unit CU in such a manner that a selected one thereof is switched to its conductive state. The other terminal of each solenoid Cn is connected to a current return conductor or to ground. Shown in FIGS. 4 and 5*a* is the energization of the two solenoids Cn and Cn−1 disposed on opposite sides of stopper device Fn, the stop member 23*n* of which is in its stop position PII, at the instant requiring stop member 23*n* to be returned to its passive position PI. The two adjacent stopper devices Fn−1 and Fn+1 as well as the remaining stopper devices (FIG. 5*a*) are all at their passive positions. For better understanding, FIG. 5*a* may be considered in connection with FIG. 6*a*, which shows the respective circuitry, and FIG. 6*c* which shows a table representing the programming of the displacements of the various stop members of the apparatus to their respective passive positions PI. As shown in FIG. 4, the supplied current flows through the two solenoids Cn and Cn−1 in opposite directions, resulting in the polarities of the two solenoids being directed opposite to one another. The polarization of permanent magnet 24*n* is selected so that its north pole N faces towards abutment stop 25*n*, and its south pole S faces towards abutment stop 26*n*. The polarization of the two solenoids is controlled so that their respective north poles N are directed toward stopper devcie Fn, while their south poles S face toward the respective adjacent stopper devices Fn−1 and Fn+1. The magnetic flux in core 21 within the two solenoids Cn and Cr−1, respectively, is directed towards stopper device Fn, resulting in an outwards directed acceleration force acting on stop member 23*n* as indicated by an arrow along the axis of stop member 23*n*, as a result of which stop member 23*n* is displaced towards its passive position PI until buffer 27*n* comes into engagement with abutment stop 25*n* and is kept in contact therewith by the magnetic force of permanent magnet 24*n*. During this displacement of stop member 23*n*, the energization of solenoids Cn and Cn−1 may be terminated as soon as permanent magnet 24*n* is spaced a sufficient distance from abutment stop 26*n*.

Figures 6A, 6C:
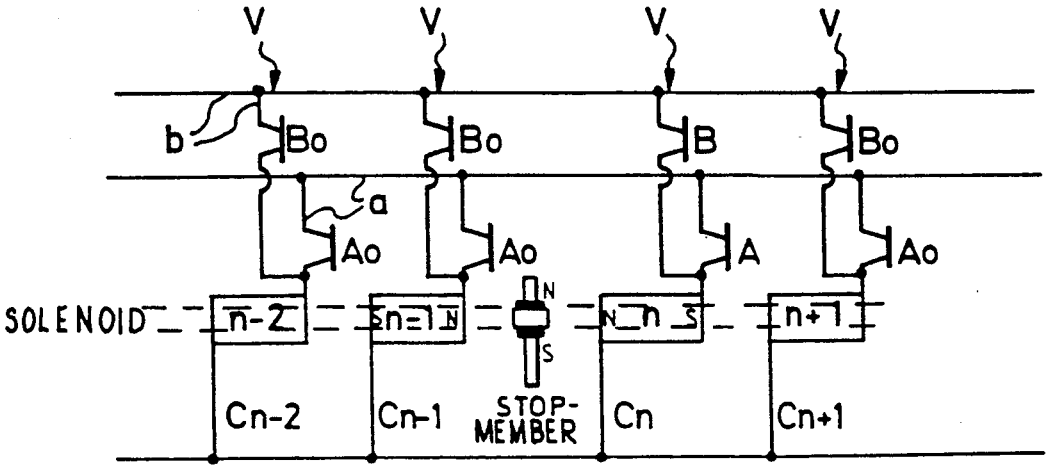
FIGS. 6*c* and 6*d* are programming tables therefor.

Due to the oppositely directed polarities of the permanent magnets 24*n*−1 and 24*n*+1 of the two adjacent stopper devices Fn−1 and Fn+1, respectively, the magnetic flux in the solenoids—likewise indicated by arrows—generates additional holding forces for these two stopper devices. As indicated in this context in FIG. 6*a*, transistor A in current reversing circuit U associated to solenoid Cn−1 is switched to its conductive state, while transistor B is in its non-conductive state as indicated by "BO". In the current reversing circuit U associated to solenoid Cn, on the other hand, transistor B is switched to its conductive state, while transistor A is in its non-conductive state, as indicated by "AO". In the current reversing circuits U associated to the adjacent solenoids, both transistors A and B are in their non-conductive state. The program for the control operation of the transistors A and B of the sixteen solenoids associated to the sixteen stopper devices is depicted in FIG. 6*c*.

Figure 5B:
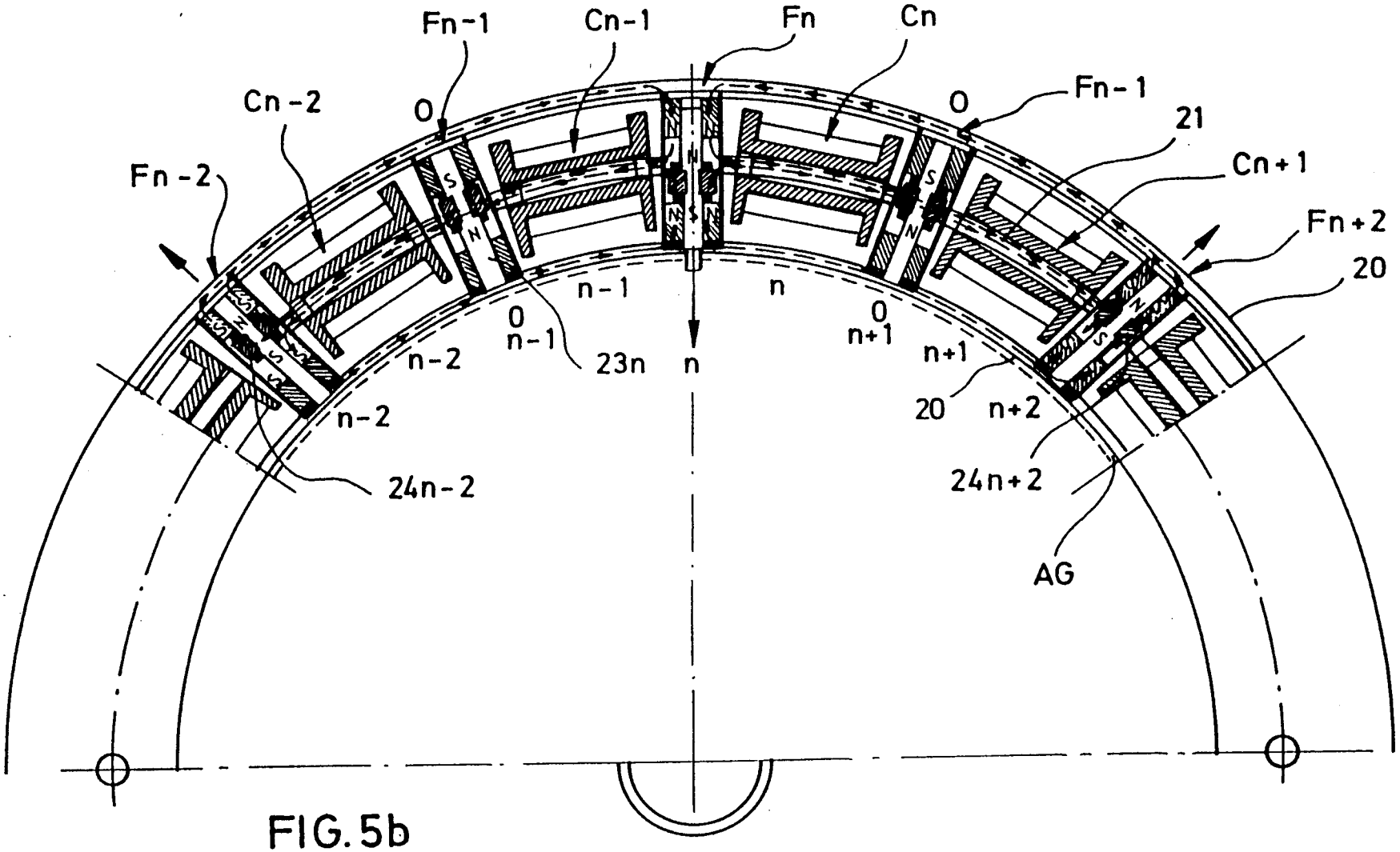
Figures 6B, 6D:
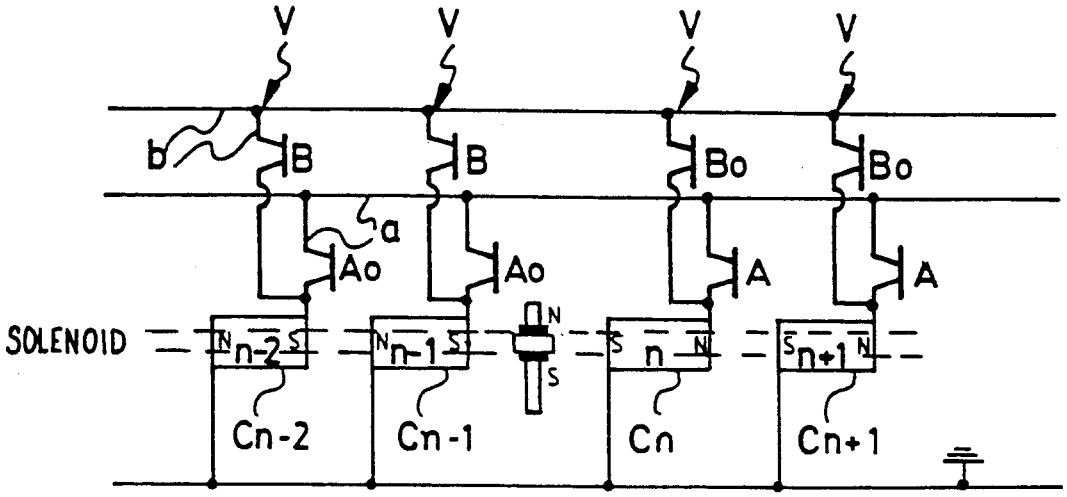

FIGS. 5*b* and 6*b* show the control operation to be selected for displacing stop member 23*n* of stopper device Fn to its stop position PII. Due to the oppositely directed polarities of the permanent magnets 24*n*, the oppositely directed current flow through the two solenoids C*n* and Cn−1 located on opposite sides of stopper device Fn would also apply a force directed towards the stop position to the stop members of the two adjacent stopper devices Fn−1 and Fn+1. In order to avoid this, the two next adjacent solenoids Cn−2 and Cn+1 are supplied with a current flowing in the same direction as in solenoids Cn−1 and Cn, respectively, as a result of which the magnetic flux in core 21 through stopper devices Fn−1 and Fn+1 is neutralized, so that a total of four solenoids cooperates to jointly generate the acceleration impulse for stopper device Fn. Since the polarity of the permanent magnets of the stopper devices Fn−2 and Fn+2 at the outer ends of solenoids Cn−? and Cn+1 is again directed in the opposite sense, as indicated by respective arrows, these stopper devices are additionally subjected to the action of holding forces in the direction towards the passive position. This is also shown in FIG. 6*b*, wherein transistors B of the current reversing circuits U associated to solenoids Cn−2 and Cn−1 are switched to their conductive state, while transistors A are non-conductive, whereas in the current reversing circuits U associated to solenoids Cn and Cn+1, transistors B are non-conductive, while transistors A are switched to their conductive state. The corresponding control diagram is shown in FIG. 6*d*.

For further reducing the load applied to each solenoid during the generation of the acceleration impulse in one or the other direction, it is possible to add any number of additional pairs of solenoids in the manner shown in FIGS. 5*a* and 5*b*. This results in the force to be generated by each solenoid being reduced, so that it is possible to employ small solenoids with a small number of windings. The paired arrangement of cooperating solenoids for each stop member to be actuated additionally results in an intensifying effect on the magnetic flux in core 21 to thereby generate a very rapid and strong acceleration impulse. In combination with the bistable mounting arrangement of each stop member, this results in a desirably rapid and smooth response and the desired short shifting times. In this case it would for instance be sufficient to have each solenoid energized by a respective capacitor, the time-wise limited discharge current of which would be sufficient for actuating the associated stop member.

If one were to consider stopper device Fn by itself alone, it would in summary only be required to simultaneously supply respective currents to solenoids Cn−1 and Cn for displacing stop member 23*n* from its stop position PII to its passive position PI, and at the same time to hold the adjacent stop members 23*n*−1 and 23*n*+1 in the passive position PI with an increased force. The displacement of stop member 23*n* to its stop position PII, on the other hand, solely requires the four sclenoids Cn−2, Cn−1, Cn and Cn+1 to be energized in the manner described, to thereby simultaneously prevent stop members 23*n*−1 and 23*n*+1 from being likewise displaced to their stop positions, and to hold the next adjacent stop members in their passive position with an increased force.

It would also be conceivable to dimension and arrange the solenoids in such a manner that the acceleration impulse applied to any given stop member is only sufficient for overcoming the holding force between the associated permanent magnet and one of the two abutment stops when two or more solenoids cooperate with one another. In an arrangement of this type the next adjacent stop members would remain in their passive positions, irrespective of their oppositely directed polarity, when they have the magnetic force of only one solenoid applied thereto. In a further possible modification core 21 may be used to act as the abutment stop defining the passive position in cooperation with the magnetic force of the respective permanent magnet, in which case the outer abutment stops 25*n* . . . could be omitted.

This modification results in several advantages:

The actuation of each stop member is accomplished by the cooperation of a plurality of solenoids, as a result of which the load acting on each solenoid remains rather low, permitting the volume of the solenoids to be correspondingly reduced. The bistable mounting arrangement of each stop member results in the advantage that its actuation requires only a very short current pulse to be applied to the respective solenoids for releasing the stop member from its one end position and accelerating it towards its other end position. This permits the thermic load acting on the solenoids to be reduced. The solenoids may also be energized by the discharge current of associated capacitors, thus reducing the danger resulting from a possible collapse of the control circuits in the case of transistor-controlled solenoids. The displaceable mass in each stopper device is extremely small, resulting in reduced bearing drag of the stop members and a high shifting speed. The only appreciable mass of each stop member is defined by the respective permanent magnet, which produces moreover an intensifying effect on the displacement of the stop member due to its attraction towards the abutment stops. For still further improving the activating response of the stop members, an extremely low-inertia actuating means could be provided by using the movable solenoid principle, in which case each stop member would only carry the negligible mass of a solenoid winding, while the heavier components employed for inducing the movement of the solenoid would be mounted at stationary positions.

Figure 7:
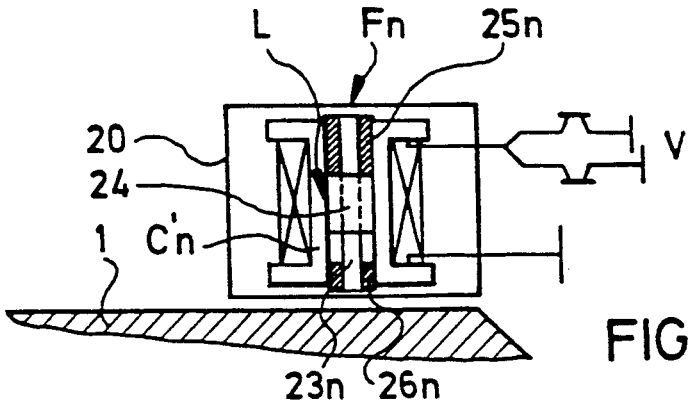
FIG. 7 is a sectional detail view, similar to FIG. 2, of a modification.

In the embodiment of FIG. 7, use is likewise made of the positive effect of a small and relatively weak solenoid C'n resulting from the cooperation of a solenoid adapted to be energized in opposite directions with the bistable mounting of stop member 23*n*. In this embodiment, however, solenoid C'n extends in a radial direction with respect to storage drum 1. Stop member 23*n* is displaceable in the direction of the solenoid axis. Abutment stops 25*n* and 26*n* are accommodated within the solenoid. Annular housing 20 is of reduced dimensions in the radial direction.

Figure 8:
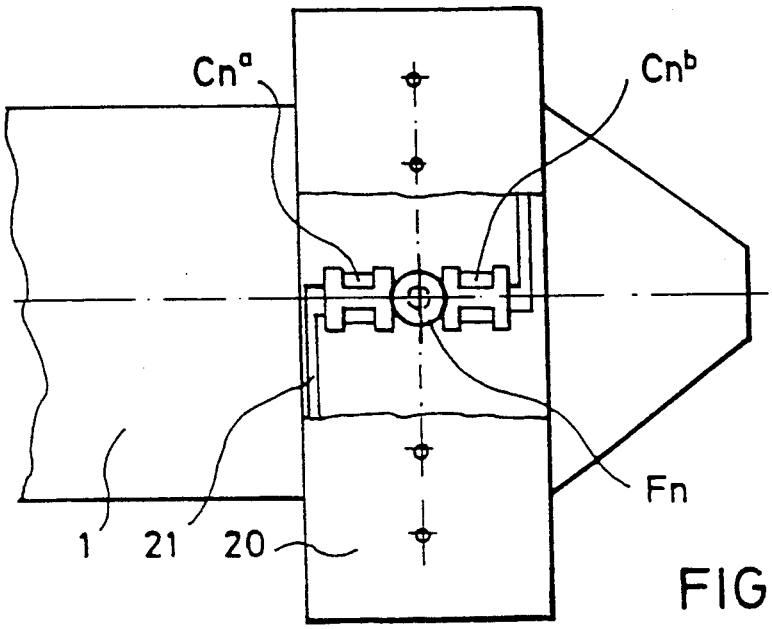
FIG. 8 is a partially sectional view similar to FIG. 1 of a further modification.

In the embodiment shown in FIG. 8, each stopper device Fn has two solenoids $Cn^a$, $Cn^b$ associated therewith in such a manner that their axes extend approximately parallel to the axis of storage drum 1. Core 21 is of a meander configuration. The stopper devices can be placed very closely adjacent one another. In this arrangement the two solenoids of any stopper device exert no influence on the adjacent stopper devices. The force, however, required for the displacement of the stop member is divided between the two solenoids of each stopper device, permitting the use of small and relatively weak solenoids.

Figure 9:
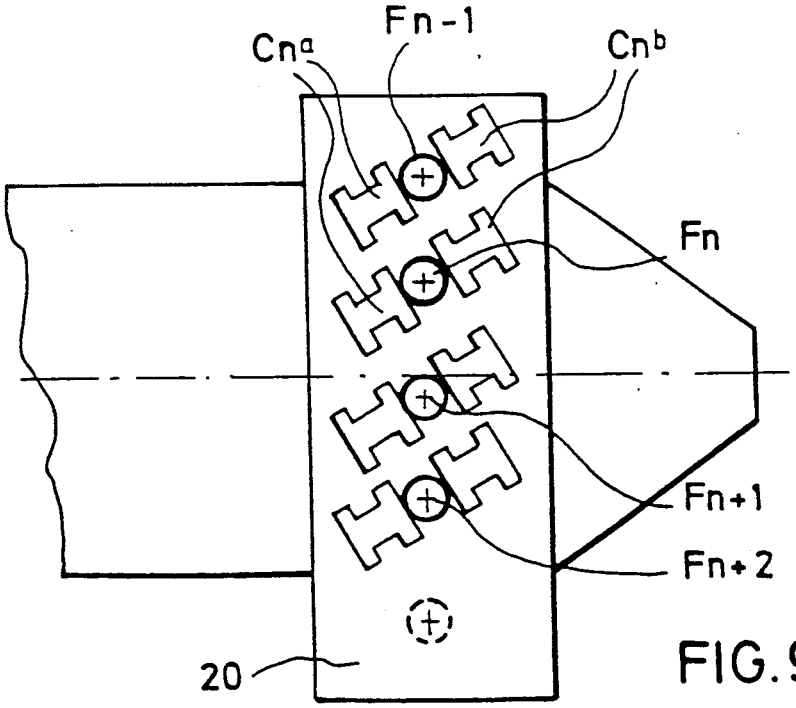
FIG. 9 is a view like FIG. 8 and showing another modification.

In the embodiment according to FIG. 9, each stopper device Fn . . . has likewise a pair of solenoids $Cn^a$, $Cn^b$ associated therewith, the axes of the solenoids being aligned with one another and inclined relative to the circumferential direction of annular housing 20, so that the solenoids are partially overlapped as seen in the axial direction. Any interference between the solenoids of adjacent stopper devices does not take place, although the force required for inducing the displacement of the stop member of the respective stopper device is again divided between the two associated solenoids. This embodiment also permits the stopper devices to be placed very closely adjacent one another.

In the embodiments of FIGS. 8 and 9, the current flow through the employed solenoids is reversible, and the bistable mounting arrangement is provided for each stop member, permitting the employ of small and relatively weak solenoids. In these embodiments the two solenoids associated to each stopper device could also be directly connected to a current supply circuit, i.e. without the interposition of a current reversing circuit, so that a respective one of the two solenoids would be energizable to generate the acceleration impulse in one direction. Thanks to the bistable mounting of the associated stop member, a relatively small and weak solenoid would still be sufficient, even if it were alone responsible for generating the acceleration impulse in one or the other direction. This would also result in a space-saving effect. It would finally be conceivable to provide each stopper device with a greater number of solenoids in a star configuration, with the current flow through the solenoids being preferably reversible.

The selective control of the solenoids and the transistors associated therewith diagrammatically shown in FIGS. 6*a* and 6*b* may be suitably accomplished by means of conventional driver stages by using a corresponding program routine of a central control unit including a microprocessor, for instance in the manner described in European Patent 107,110. In this case the central control unit would be designed and programmed to perform the proper calculations for the actuation of any given stop member at the respective right instant.

I claim:

1. Apparatus for storing, feeding and measuring a yarn, comprising a stationary storage drum, a winder appliance for winding a temporary yarn supply onto said storage drum, said storage drum having a withdrawal end over which the yarn can be withdrawn, an annular housing surrounding said storage drum and defining an annular gap therebetween, said annular housing carrying at least one yarn stopper device comprising a stop member mounted for radial displacement between a passive position away from said annular gap and a stop position extending across said annular gap, at least one current-energizable solenoid for actuating said stop member, and abutment stops for limiting the displacements of said stop member between said positions, said stopper device being provided with a bistable and self-latching locking means for releasably locking said stop member in said positions, said locking means comprising a polarized permanent magnet connected to said stop member, a current reversing circuit connected to said solenoid for displacing said stop member from its respective positions and for deenergizing said solenoid when said stop member is disposed in its respective positions, said apparatus including an even number of stopper devices at uniform circumferential spacings on said housing, and including a plurality of solenoids having their solenoid axes aligned substantially in the circumferential direction and being disposed between said stopper devices, any two adjacent solenoids being jointly associated with one stopper device, and the polarities of said permanent magnets of two adjacent stopper devices being directed opposite to one another.

2. Apparatus according to claim 1, in which the abutment stops for said polarized permanent magnet in said bistable locking means consist of a ferromagnetic material.

3. Apparatus according to claim 1, in which said current reversing circuit contains selectively energizable capacitors.

4. Apparatus according to claim 1, any two adjacent solenoids associated with said permanent magnet of a stopper device for the displacement thereof to one of said positions simultaneously cooperate with permanent magnets of other stopper devices for holding them in the other of said positions.

5. Apparatus according to claim 1, in which said any two adjacent solenoids jointly associated with one stopper device are adapted to be energized in opposite directions, and that the holding force between said permanent magnet and each abutment stop is smaller than the magnetic force generated by the respective pair of solenoids and acting on said permanent magnet, said holding force being greater than the magnetic forces generated by the energization of each solenoid and acting on the permanent magnets of stopper devices adjacent to the activated stopper device.

6. Apparatus for storing, feeding and measuring a yarn, comprising a stationary storage drum, a winder appliance for winding a temporary yarn supply onto said storage drum, said storage drum having a withdrawal end over which the yarn can be withdrawn, an annular housing surrounding said storage drum and defining an annular gap therebetween, said annular housing carrying at least one yarn stopper device comprising a stop member mounted for radial displacement between a passive position away from said annular gap and a stop position extending across said annular gap, at least one current-energizable solenoid for actuating said stop member, and abutment stops for limiting the displacements of said stop member between said positions, said stopper device being provided with a bistable and self-latching locking means for releasably locking said stop member in said positions, said locking means comprising a polarized permanent magnet connected to said stop member, a current reversing circuit connected to said solenoid for displacing said stop member from its respective positions and for deenergizing said solenoid when said stop member is disposed in its respective positions, said apparatus including a circumferentially closed annular soft-iron core which extends through said solenoids along their axes, said core being provided with recesses for said stopper devices between said solenoids.

7. Apparatus according to claim 6, in which the abutment stop for said polarized permanent magnet defining said passive position is formed by said soft-iron core itself.

8. Apparatus according to claim 6, in which each stopper device is disposed between two solenoids disposed substantially parallel to the drum axis.

9. Apparatus for storing, feeding and measuring a yarn, comprising a stationary storage drum, a winder appliance for winding a temporary yarn supply onto said storage drum, said storage drum having a withdrawal end over which the yarn can be withdrawn, an annular housing surrounding said storage drum and defining an annular gap therebetween, said annular housing carrying at least one yarn stopper device comprising a stop member mounted for radial displacement between a passive position away from said annular gap and a stop position extending across said annular gap, at least one current-energizable solenoid for actuating said stop member, and abutment stops for limiting the displacements of said stop member between said positions, said stopper device being provided with a bistable and self-latching locking means for releasably locking said stop member in said positions, said locking means comprising a polarized permanent magnet connected to said stop member, a current reversing circuit connected to said solenoid for displacing said stop member from its respective positions and for deenergizing said solenoid when said stop member is disposed in its respective positions, said current reversing circuit comprising transistors disposed in parallel connecting conductors of each solenoid and a central control unit for activating said current reversing circuit.

10. Apparatus according to claim 9, in which each stopper device with its bistable locking means is housed in a radially aligned said solenoid.

11. Apparatus according to claim 9, including a plurality of solenoids disposed in pairs in oblique alignment relative to the circumferential direction of said drum and overlapping one another in the circumferential direction of said drum.

12. Apparatus according to claim 9, in which said stopper device comprises a bushing of a non-magnetic material retained in said annular housing in radial alignment, said abutment stops in the form of rings of a ferromagnetic material being disposed at fixed positions in said bushing, the side of said bushing facing towards said storage drum being closed by a resilient seal.

13. Apparatus according to claim 12, in which said bushing is provided with internally threaded portions for the screw-thread adjustment of said abutment stops.

14. Apparatus according to claim 9, in which said stop member is a plastic pin displaceably guided in said abutment stops, said permanent magnet is of annular configuration and secured at a fixed position on said pin, and the end, portion of said pin adjacent said storage drum is provided with a wear-resistant lining.

15. Apparatus according to claim 14, in which between the end faces of said permanent magnet and each abutment stop there is provided a resilient buffer.

16. Apparatus for storing, feeding and measuring a yarn, comprising a stationary storage drum, a winder appliance for winding a temporary yarn supply onto said storage drum, said storage drum having a withdrawal end over which the yarn can be withdrawn, an annular housing surrounding said storage drum and defining an annular gap therebetween, said annular housing carrying at least one yarn stopper device comprising a stop member mounted for radial displacement between a passive position away from said annular gap and a stop position extending across said annular gap, at least one current-energizable solenoid for actuating said stop member, and abutment stops for limiting the displacements of said stop member between said positions, said stopper device being provided with a bistable and self-latching locking means for releasably locking said stop member in said positions, said locking means comprising a polarized permanent magnet connected to said stop member, a current reversing circuit connected to said solenoid for displacing said stop member from its respective positions and for deenergizing said solenoid when said stop member is disposed in its respective positions, said current reversing circuit for the displacement of said stop member from its stop position being connected to energize a first pair of solenoids enclosing said stopper device therebetween in opposite directions, and for the displacement of said stop member from its passive position, said current reversing circuit being connected to energize said first pair solenoids enclosing said stopper device therebetween in reversed and opposite directions, and to energize a second pair of solenoids adjacent to said first pair of solenoids in the same direction as the first pair of solenoids to thereby neutralize the magnetic flux for the permanent magnets in stopper devices disposed adjacent said stop member.

17. Apparatus according to claim 16, in which for the displacement of said stop member from one or the other of its positions, said current reversing circuit is connected to energize an even number of further solenoids disposed adjacent to one of said first pair of solenoids in the same directions as said first pair of solenoids.

* * * * *